US005566392A

United States Patent [19]

Dzelzkalns

[11] Patent Number: 5,566,392

[45] Date of Patent: Oct. 22, 1996

[54] NO-SLIP UNDERCLOTHING

[76] Inventor: Brenda Dzelzkalns, 3524 Chatham Green La., #813, Arlington, Tex. 76014

[21] Appl. No.: 349,674

[22] Filed: Dec. 5, 1994

[51] Int. Cl.[6] ..... A41B 9/00

[52] U.S. Cl. ..... 2/73; 450/110

[58] Field of Search ..... 2/73, 70, 71, 72, 2/69; 450/110

[56] References Cited

U.S. PATENT DOCUMENTS

| | | | |
|---|---|---|---|
| 1,201,860 | 10/1916 | Nelke | 2/71 |
| 1,251,030 | 12/1917 | Hoffman | 2/73 |
| 1,419,940 | 6/1922 | Mills | 2/71 |
| 1,445,523 | 2/1923 | McHolland | 2/71 |
| 1,552,733 | 9/1925 | Rhoden | 2/71 |
| 1,691,790 | 11/1928 | Volker | 2/71 |
| 3,060,446 | 10/1962 | Horne | 2/73 |
| 3,162,197 | 12/1964 | Erteszek | 2/73 |
| 3,292,629 | 12/1966 | Steinberger | 2/73 |
| 3,399,679 | 9/1968 | Barg | 2/71 |
| 3,417,756 | 12/1968 | Leventhal | 2/71 |

*Primary Examiner*—C. D. Crowder
*Assistant Examiner*—Gloria Hale
*Attorney, Agent, or Firm*—Ruben C. DeLeon

[57] ABSTRACT

This is an article of underclothing that may be worn under skirts and dresses. The article may comprise of: a plurality of rear panels 20, 22 attached together; a plurality of frontal panels 10, 12, 14 attached together and attached to the plurality of rear panels at two inseams and two outerseams 28 to provide a waist opening and two leg openings; and a frontal slip panel 24 attached to the plurality of rear panels 20, 22 and the plurality of front panels 10, 12, 14 at the two outerseams. The underclothing may include lace panels 26 attached to the leg openings to provide various lengths to the underclothing. The underclothing may also include a torso panels attached to the rear panels and the frontal panels to create a body suit with the underclothing. The underclothing may also include a cotton insert 16 attached to the frontal panels 10, 12, 14 and rear panels 20, 22 at a crotch area of the underclothing. The underclothing may also include garter straps attached at the leg openings to provide support for stockings. The underclothing may also include stiffer frontal panels to provide tummy control to the underclothing. In addition, the no-slip could contain a fanny pad.

20 Claims, 3 Drawing Sheets

NO-SLIP UNDERCLOTHING

FIELD OF THE INVENTION

The field of the invention generally relates to underclothing, and particularly to underclothing worn under skirts and dresses.

BACKGROUND

Almost as long as women have been wearing dresses, women have also worn some sort of slip underneath. However, the modern slip is quite different from its ancestors. The early slips ranged from petticoats to cotton linings and were usually bulky. In contrast, the modern slip is usually made of some thin material like rayon or polyester. Some slips even contain some sort of control panel which attempts to provide a smoother frontal impression. Overall, the modern slip acts as an opaque covering between the woman's dress or skirt and her legs.

In addition, a more recent clothing invention to be worn underneath dresses and skirts is the pantyhose. Undoubtedly, the pantyhose is of great importance to the modern woman. Pantyhose have a multitude of functions. They keep a woman's legs warmer in colder weather. They add color to woman's outfit. They may make a woman's legs look smoother than they really are. In addition, pantyhose also provide the support of underwear while covering the legs with a sheer material.

SUMMARY OF THE INVENTION

Even though the use of the slip and pantyhose has become very popular, and often essential to the modern women, the simultaneous use of both have caused some problems. Many women can testify to the problem of trying to keep up their pantyhose while keeping their slip extended. The only previous solution to this endeavor, was for women to straighten their slips after pulling up their pantyhose. This routine of pulling up and straightening had become a torment to the well dressed women.

In contrast, the present invention provides a unique solution to this problem. The present invention (the "no-slip") combines shorts of an elastic material with a frontal panel attached from one outerseam to the other to act as a slip. The no-slip would be put on after the pantyhose and replace the slip. The unique design of the no-slip enables the wearer to keep their pantyhose up while keeping the slip down and smooth with no wrinkling or riding up.

While other attempts have been made to provide a slip that holds up pantyhose, the other solutions do not work as well as the no-slip. One solution attaches a band of material from the from portion of the slip to the back portion. However, this solution looks awkward when wearing tight skirts or dresses because it pulls in the skirt or dress in the area of the slip that is attached to the band material. Another solution attaches the band material to the slip near the top of the slip. Yet this solution is not as comfortable or as attractive as the present invention and also has the disadvantages of the previous solution. Furthermore, no other solution keeps the slip from creeping up the pantyhose like the no-slip does.

In contrast, the no-slip's unique design does not have the shortcomings of the previous solutions. In addition, the no-slip is comfortable to wear while providing the functions of a slip.

Additionally, the no-slip could be made with various options. A torso covering could be added to the shorts and panel to provide a body suit. Moreover, the no-slip could be made with sections on the bottom that could be cut off to provide a multitude of lengths to match the various lengths of dresses and skies. Furthermore, the shorts portion of the no-slip could provide a cotton crotch for comfort. Optionally, the shorts portion could be made crotchless.

Another embodiment could provide garter straps for stockings. Yet another embodiment could provide stiffer from pands on the shorts to provide tummy control. Alternately, the slip panel could be placed in the rear. In addition, instead of using shorts, the present invention could use a type of girdle. Another embodiment could combine the shorts portion of the present invention with pantyhose to produce a slip and pantyhose combination.

This is an article of underclothing that may be worn under skirts and dresses. The article may comprise of: a plurality of rear panels attached together; a plurality of frontal panels attached together and attached to the plurality of rear panels at two inseams and two outerseams to provide a waist opening and two leg openings; and a frontal slip panel attached to the plurality of rear panels and the plurality of from panels at the two outerseams. The underclothing may include lace panels attached to the leg openings to provide various lengths to the underclothing. The underclothing may also include a torso panels attached to the rear panels and the frontal panels to create a body suit with the underclothing. The underclothing may also include a cotton insert attached to the frontal panels and rear panels at a crotch area of the underclothing. The underclothing may also include garter straps attached at the leg openings to provide support for stockings. The underclothing may also include stiffer frontal panels to provide tummy control to the underclothing.

BRIEF DESCRIPTION OF THE DRAWINGS

This invention can be best understood by reference to the following drawing(s), in which.

Corresponding numerals and symbols in different figures refer to corresponding parts unless otherwise indicated.

DETAILED DESCRIPTION OF PREFERRED EMBODIMENTS

Figure 1:
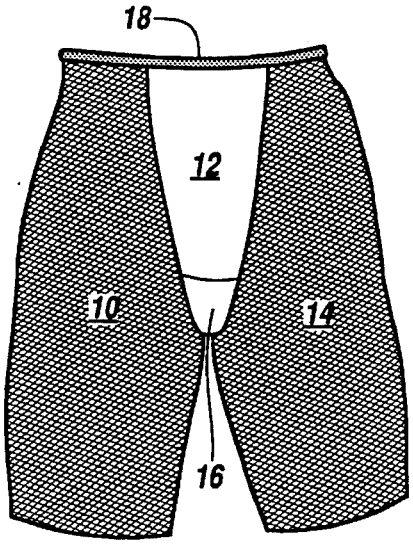
FIG. 1 shows a schematic of the front view of the preferred embodiment.

One preferred embodiment will be described in reference to FIGS. 1 and 2. FIG. 1 shows an example embodiment of the present invention from a frontal view. In this example, the shorts are made up of three panels 10, 12, 14 in the front. The shorts may be made up of any stretchy material (e.g. material containing spandex®, LYCRA®, nylon or combinations thereof). The slip front panel (not shown) may be made of a smooth and/or stretchy material (e.g. material containing spandex®, LYCRA®, nylon, polyester, silk or combinations thereof). In addition, the shorts have a cotton insert 16 for maximum comfort. Moreover, an optional elastic band 18 is shown at the top of the shorts.

Figure 2:
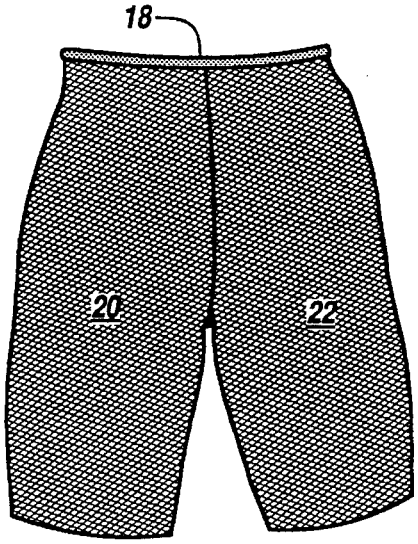
FIG. 2 shows a schematic of the rear view of the preferred embodiment.

FIG. 2 shows the present invention from the rear view. Two panels 20, 22 make up the shorts and would preferably be made up of the same material as the front panels in FIG. 1. The rear panels 20, 22 would be sewn to the front panels 10, 14 at the two outerseams (not shown).

Figure 3:
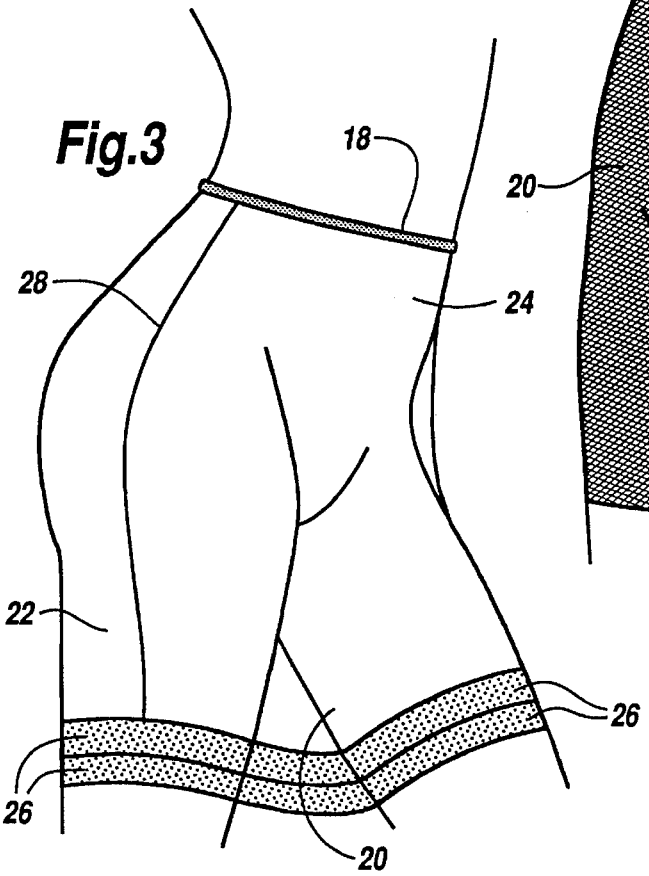
FIG. 3 shows an illustration of the side view of the preferred embodiment as it would appear worn by a woman.

FIG. 3 shows the present invention from a side view as it would appear worn by a woman. The slip front panel 24 is shown attached to the rear panel 22 of the shorts at the outerseam 28. The slip front panel 24 would also be sewn to the other rear panel 20 of the shorts at the other outerseam (not shown). In addition, this embodiment shows a lace panel 26 that may be cutoff to provide a shorter length for the no-slip. The lace panels 26 are not necessarily drawn to scale and may be of different lengths to provide even more options or omitted entirely. Furthermore, the wearer of the no-slip may decide to keep the lace panels for its pleasant appearance. Lastly, FIG. 3 shows the optional elastic band 18 at the top of the no-slip.

Figure 4:
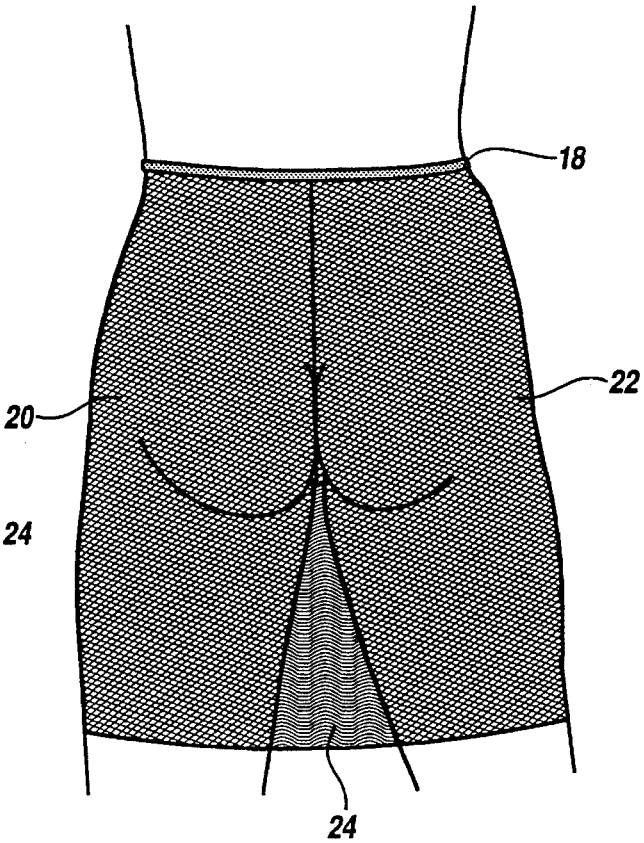
FIG. 4 shows an illustration of the rear view of the preferred embodiment as it would appear worn by a woman.

FIG. 4 shows the present invention from a rear view as it would appear worn by a woman. The rear panels 20, 22 of the shorts are shown to fit snugly on the woman while the slip panel 24 shows between her legs. This embodiment omits the optional lace panels.

Figure 5:
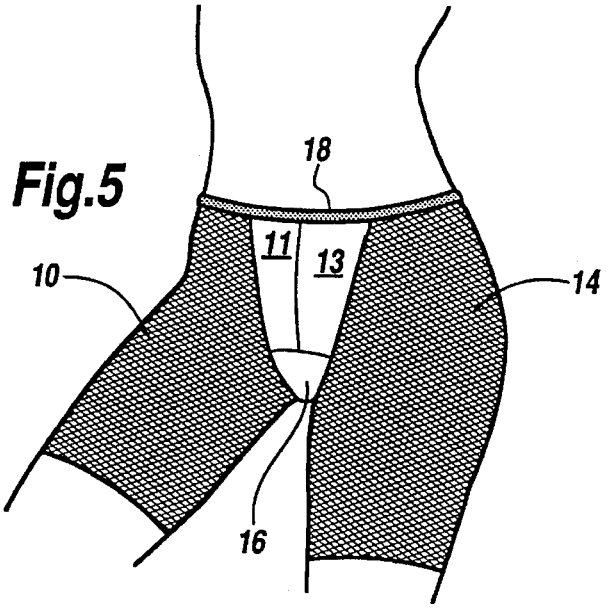
FIG. 5 shows an illustration of the front view of the shorts portion of the preferred embodiment as it would appear worn by a woman.

FIG. 5 shows the present invention from a frontal view as it would appear worn by a woman. The slip panel is omitted from this illustration to show the detail of the shorts portion of the no-slip. This embodiment is shown to have four front panels 10, 11, 13, 14 with a cotton insert 16. This embodiment also omits the optional lace panels. Front panels 11 and 13 may optionally contain a stiffer material in order to provide tummy control to the shorts.

Figure 6:
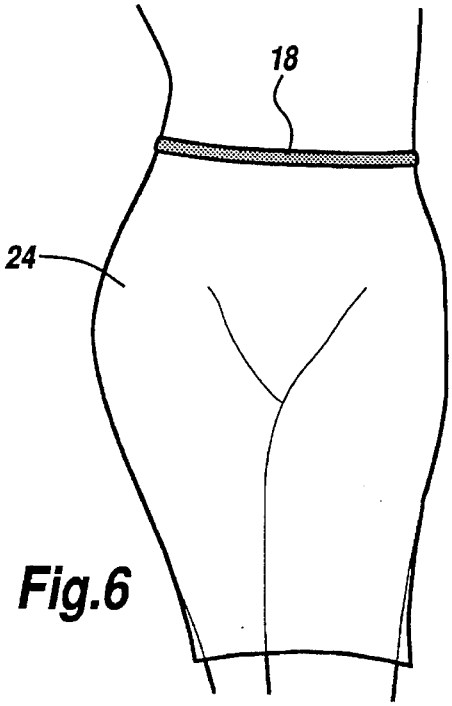
FIG. 6 shows an illustration of the front view of the preferred embodiment as it would appear worn by a woman.

FIG. 6 shows the present invention from a frontal view as it would appear worn by a woman. In this illustration, the slip panel 24 covers the shorts portion of the no-slip. This illustration shows how the no-slip would look before the wearer slips on her dress or skirt.

Figure 7:
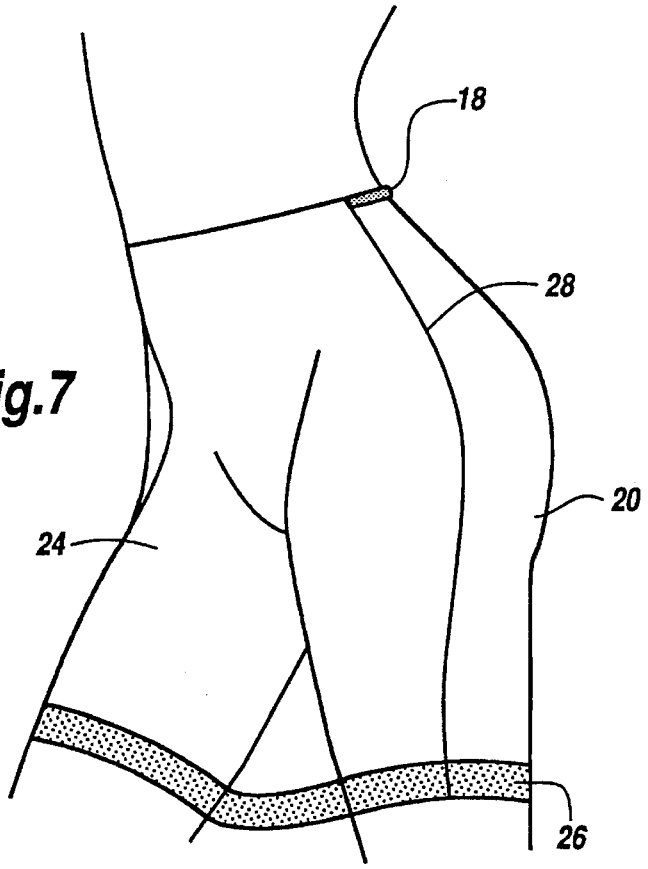
FIG. 7 shows an illustration of the combination of the front and side view of the preferred embodiment as it would appear worn by a woman.

FIG. 7 shows the present invention from a combination side view and frontal view. The slip panel 24 covers the front panels of the shorts while the rear panel 20 is shown. In addition, this embodiment shows the optional elastic waist band and the optional lace panel 26.

Figure 8:
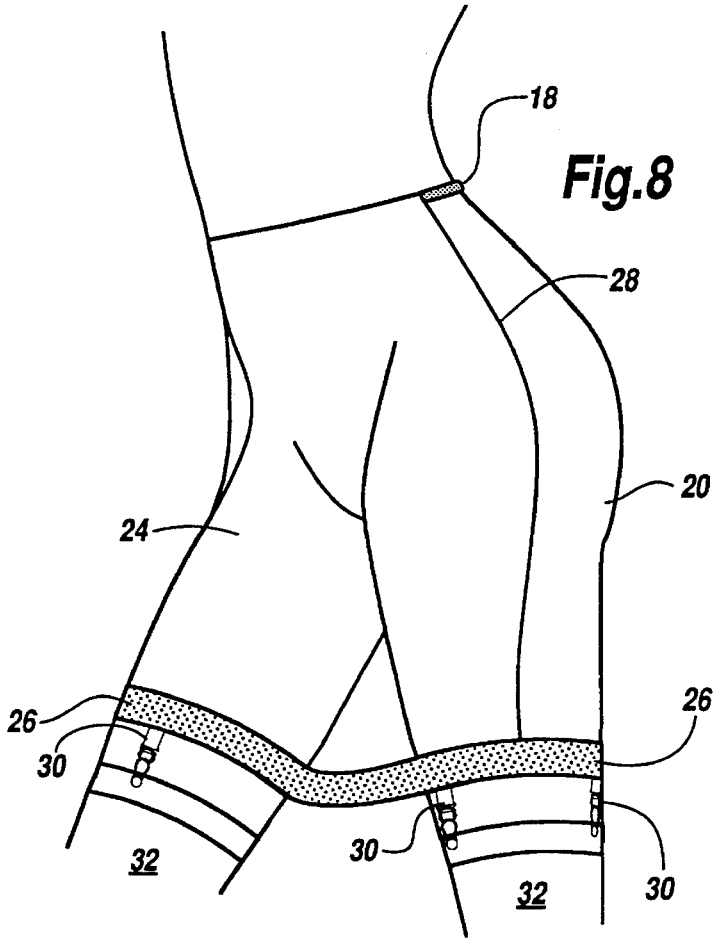
FIG. 8 shows an illustration of the combination of the front and side view of the preferred embodiment as it would appear worn by a woman.

FIG. 8 shows the present invention from a combination side view and frontal view. The slip panel 24 covers the front panels of the shorts while the rear panel 20 is shown. In addition, this embodiment shows the optional elastic waist band and the optional lace panel 26. Furthermore, this embodiment shows the optional garter straps 30 attached to stockings 32.

Figure 9:
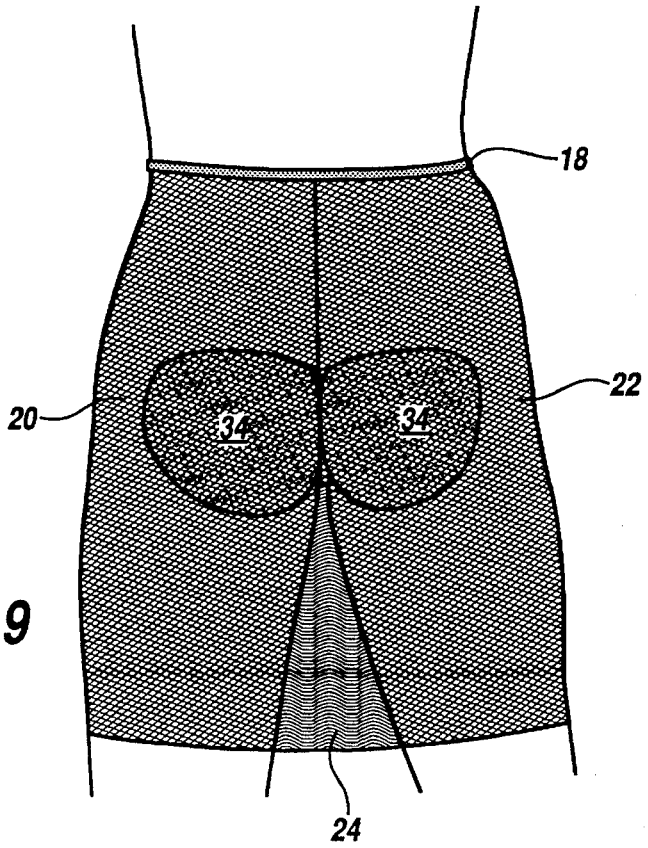
FIG. 9 shows an illustration of the rear view of the preferred embodiment as it would appear worn by a woman.

FIG. 9 shows the present invention from a rear view as it would appear worn by a woman. The rear panels 20, 22 of the shorts are shown to fit snugly on the woman while the slip panel 24 shows between her legs. This embodiment omits the optional lace panels. However, this embodiment shows fanny pad inserts 34 inserted in the rear panels 20, 22 of the shorts.

The present invention could have other modifications and still be useful to the wearer. A body suit could be made by connecting the slip panel 24 and/or the shorts portion to a torso portion of a conventional body suit. The torso portion could be made of the same material as the shorts portion or be made of a softer or smoother material (e.g. silk, rayon, . . . ). The no-slip could also be with or without the cotton insert. Optionally, the no-slip could be made crotchless. In addition, the no-slip could contain garter straps to connect to stockings. Another embodiment could contain a padded fanny portion in the rear panels of the shorts. Optionally, the no-slip could provide a rear panel instead of the front panel illustrated in the figures.

In addition, instead of using shorts, the present invention could use a type of girdle. Another embodiment could combine the shorts portion of the present invention with pantyhose to produce a slip and pantyhose combination.

Furthermore, although the no-slip was designed to solve the problem of straightening slips and pulling up pantyhose, the no-slip could also be worn as outerwear as well as under other clothing.

Various modifications have already been described but other modifications and combinations of the illustrative embodiments, as well as other embodiments of the invention, will be apparent to persons skilled in the art upon reference to the description. In particular, other materials may be used to create the no-slip while staying in the spirit of the invention. It is therefore intended that the appended claims encompass any such modifications or embodiments.

I claim:

1. A method of forming a combination slip and shorts, said method comprising:

attaching a plurality of elastic rear panels of said shorts to a plurality of elastic frontal panels of said shorts at two inseams and two outerseams to provide a waist opening and two leg openings; and attaching a single slip panel to said plurality of rear panels and said plurality of front panels at said two outerseams of said shorts.

2. The method of claim 1, wherein said attaching a slip panel to said shorts attaches said slip panel over said plurality of frontal panels.

3. The method of claim 1, wherein said attaching a slip panel to said shorts attaches said slip panel over said plurality of rear panels.

4. The method of claim 1, wherein said method further includes attaching lace panels to said leg openings to provide various lengths to said combination slip and shorts by allowing said lace panels to be cut off at each panel separation.

5. The method of claim 1, wherein said method further includes attaching a plurality of torso panels to said rear panels and said frontal panels.

6. The method of claim 1, wherein said method further includes attaching a cotton insert to said frontal panels and rear panels at a crotch area of said shorts.

7. The method of claim 1, wherein said method further includes attaching garter straps at said leg openings to provide support for stockings.

8. The method of claim 1, wherein said method further includes providing a plurality of stiffer frontal panels to provide tummy control to said shorts.

9. The method of claim 1, wherein said method further includes providing a fanny pad to said plurality of rear panels.

10. An article of underclothing, said article comprising:

a plurality of elastic rear panels attached together;

a plurality of elastic frontal panels attached together and attached to said plurality of rear panels at two inseams and two outerseams to provide a waist opening and two leg openings; and a single slip panel attached to said plurality of rear panels and said plurality of front panels at said two outerseams.

11. The underclothing of claim 10, wherein said slip panel is attached over said plurality of frontal panels.

12. The underclothing of claim 10, wherein said slip panel is attached over said plurality of rear panels.

13. The underclothing of claim 10, wherein said underclothing further includes a plurality of lace panels attached to said leg openings to provide various lengths to said underclothing by allowing said lace panels to be cut off at each panel separation.

14. The underclothing of claim 10, wherein said underclothing further includes a plurality of torso panels attached to said rear panels and said frontal panels.

15. The underclothing of claim 10, wherein said underclothing further includes a cotton insert attached to said frontal panels and rear panels at a crotch area of said underclothing.

16. The underclothing of claim 10, wherein said underclothing further includes garter straps attached at said leg openings to provide support for stockings.

17. The underclothing of claim 10, wherein said underclothing further includes a plurality of stiffer frontal panels to provide tummy control to said underclothing.

18. The underclothing of claim 10, wherein said underclothing further includes a fanny pad provided by said plurality of rear panels.

19. The underclothing of claim 10, wherein said single slip panel is a rear panel.

20. The underclothing of claim 10, wherein said single slip panel is a frontal panel.

* * * * *